US007874766B2

(12) United States Patent
Yano

(10) Patent No.: US 7,874,766 B2
(45) Date of Patent: Jan. 25, 2011

(54) JET-MIXING METHOD AND JET-MIXING APPARATUS

(75) Inventor: Hideo Yano, Chiba (JP)

(73) Assignees: Daiei Sangyo Co., Ltd., Chiba-Shi, Chiba (JP); Fujijyuki Koji Co. Ltd., Tokyo (JP)

( * ) Notice: Subject to any disclaimer, the term of this patent is extended or adjusted under 35 U.S.C. 154(b) by 384 days.

(21) Appl. No.: 12/170,841

(22) Filed: Jul. 10, 2008

(65) Prior Publication Data

US 2010/0006168 A1 Jan. 14, 2010

(51) Int. Cl.
*F16K 11/00* (2006.01)

(52) U.S. Cl. ..... 405/233; 405/253; 175/21; 137/890

(58) Field of Classification Search ..... 405/232, 405/233, 253; 175/19, 21
See application file for complete search history.

(56) References Cited

U.S. PATENT DOCUMENTS

| | | | | |
|---|---|---|---|---|
| 3,763,654 | A * | 10/1973 | Matsushita | 405/232 |
| 4,397,588 | A * | 8/1983 | Goughnour | 405/236 |
| 6,231,270 | B1 * | 5/2001 | Cacossa | 405/248 |
| 6,241,426 | B1 * | 6/2001 | Schellhorn | 405/267 |

FOREIGN PATENT DOCUMENTS

| | | |
|---|---|---|
| JP | 2000 027173 | 1/2000 |
| JP | 2000 290991 | 10/2000 |
| JP | 2001 279661 | 10/2001 |
| JP | 2005 113647 | 4/2005 |

* cited by examiner

*Primary Examiner*—Tara Mayo-Pinnock
(74) *Attorney, Agent, or Firm*—K&L Gates LLP

(57) ABSTRACT

The invention provides a jet-mixing method for casting a pile of predetermined diameter by thrusting or feeding into the ground a rod provided at its lower end with a first jet nozzle section for jetting ground improvement medium and a second jet nozzle section for jetting reactant in substantially the same direction as the jet direction of the first jet nozzle section, and provided above the first and second jet nozzle sections with a third jet nozzle section for mixing and jetting compressed air and water in a direction opposite the jet direction of the first and second jet nozzle sections, jetting compressed air and water within a predetermined range while simultaneously rotating and upwardly extracting the rod from the ground, thereby jet-cutting a ground improvement region into a cylindrical shape, discharging mud generated by the cutting operation to the ground surface through a bored hole, and jetting the reactant from the second jet nozzle section and jetting the ground improvement medium from the first jet nozzle section. A jet-mixing apparatus for implementing the method is also provided.

10 Claims, 3 Drawing Sheets

JET-MIXING METHOD AND JET-MIXING APPARATUS

BACKGROUND OF THE INVENTION

1. Field of the Invention

This invention relates to a jet-mixing method and a jet-mixing apparatus for casting piles in soft ground by impregnating the ground with a ground improvement medium, particularly to a jet-mixing method and a jet-mixing apparatus in which a lower first jet nozzle section and a lower second jet nozzle section respectively jet reactant and ground improvement medium in substantially the same direction and an upper third jet nozzle section jets mixed compressed air and water in a direction opposite that of the reactant and ground improvement medium.

2. Description of the Related Art

In building construction and civil engineering, it is a known practice to solidify soft ground before starting the construction work, by impregnating the ground with a ground hardening material. Although various methods have been developed for this type of ground improvement, the jet-mixing method is in particularly wide use because of its operability and reliability advantages.

As taught by Assignee's Japanese Patent Application No. 2003-379126, for example, the conventional jet-mixing method crushes and cuts the ground with water pressure by strongly jetting compressed air and water from a jet nozzle section provided on a rod and then jets and mixes ground improvement medium consisting mainly of cement milk and reactant that promotes hardening of the ground improvement medium, thereby casting a pile of predetermined diameter.

The conventional jet-mixing apparatus comprises a first jet nozzle section and a second jet nozzle section installed so as to spurt material in opposite directions and a third jet nozzle section that jets mixed compressed air and water in opposite directions. So if pile casting is conducted under appropriately set conditions of, inter alia, rotational speed and lifting speed, the ground can be uniformly churned within the required region and a pile of sufficient strength can be quickly formed by adding ground improvement material and reactant.

However, in the jet-mixing method implemented using the conventional jet-mixing apparatus, the reactant and ground improvement medium are jetted in opposite directions owing to the installation of the first jet nozzle section and the second jet nozzle section in opposite directions, and therefore, depending on the ground characteristics and the working conditions, uneven mixing is liable to occur to give rise to cases in which the reactant and ground improvement medium are not properly blended.

A need has therefore been felt for the development of a jet-mixing method and a jet-mixing apparatus that prevent occurrence of uneven mixing and enable reliable blending of the reactant and the hardening material.

Patent Reference 1: Japanese Patent Application No. 2003-379126

SUMMARY OF THE INVENTION

The object of the present invention is to overcome the aforesaid problems by providing a jet-mixing method and a jet-mixing apparatus for casting piles in soft ground by impregnating the ground with a ground improvement medium, particularly to a jet-mixing method and a jet-mixing apparatus in which a lower first jet nozzle section and a lower second jet nozzle section respectively jet reactant and ground improvement medium in substantially the same direction and an upper third jet nozzle section jets mixed compressed air and water in a direction opposite that of the reactant and ground improvement medium.

In order to achieve the aforesaid object, the present invention provides a jet-mixing method and a jet-mixing apparatus adapted to cast a pile of predetermined diameter by thrusting or feeding into the ground a rod provided at its lower end with a first jet nozzle section for jetting ground improvement medium consisting mainly of cement milk and a second jet nozzle section for jetting reactant in substantially the same direction as the jet direction of the first jet nozzle section, and provided above the first and second jet nozzle sections with a third jet nozzle section for mixing and jetting compressed air and water in a direction opposite the jet direction of the first and second jet nozzle sections; jetting compressed air and water from the third jet nozzle section within a predetermined range while simultaneously rotating and upwardly extracting the rod from the ground, thereby jet-cutting a ground improvement region into a cylindrical shape; discharging mud generated by the cutting operation to the ground surface through a bored hole; and jetting reactant for solidifying the ground improvement medium from a nozzle of the second jet nozzle section and jetting the ground improvement medium from a nozzle of the first jet nozzle section.

In one aspect of the aforesaid jet-mixing method, the first jet nozzle section and the second jet nozzle section are disposed side-by-side horizontally and have their nozzles directed in substantially the same direction to make their jet directions substantially parallel and the reactant and ground improvement medium are jetted horizontally in parallel in the same direction. In another aspect of the jet-mixing method, the second jet nozzle section for jetting the reactant is installed a prescribed distance above the first jet nozzle section for jetting the ground improvement medium and the rod is rotated and lifted to cause the reactant to be mixed with the ground first and the ground improvement medium to be mixed therewith thereafter. In another aspect of the jet-mixing method, the second jet nozzle section for jetting the reactant is installed on the leading side relative to the rotational direction of the rod and the first jet nozzle section for jetting ground improvement medium consisting mainly of cement milk is installed on the trailing side at the lower end and the rod is rotated to cause the reactant to be mixed with the ground first and the ground improvement medium to be mixed therewith thereafter.

In another aspect of the jet-mixing method, solids of larger than a predetermined diameter are separated and removed from mud composed of water-containing soil discharged to the ground surface, whereafter the discharged mud is mixed with the ground improvement medium to form a mixed medium that is jetted from the first jet nozzle section as a ground improvement medium. In this aspect of the jet-mixing method, there can be adopted a method wherein solids of larger than a predetermined diameter are separated and removed from the mud composed of water-containing soil discharged to the ground surface, whereafter the discharged mud is mixed with the ground improvement medium to form a mixed medium that is force-fed by a conveying pump to be jetted from the first jet nozzle section as a ground improvement medium.

The present invention also provides a jet-mixing apparatus comprising a rod provided at its lower end with a first jet nozzle section for jetting ground improvement medium consisting mainly of cement milk and a second jet nozzle section for jetting reactant in substantially the same direction as the jet direction of the first jet nozzle section, and provided above the first and second jet nozzle sections with a third jet nozzle section for mixing and jetting compressed air and water in a direction opposite the jet direction of the first and second jet nozzle sections, which jet-mixing apparatus casts a pile of predetermined diameter by thrusting or feeding the rod into the ground, jetting compressed air and water from the third jet nozzle section within a predetermined range while simultaneously rotating and upwardly extracting the rod from the ground, thereby jet-cutting a ground improvement region into a cylindrical shape; discharging mud generated by the cutting operation to the ground surface through a bored hole; and jetting reactant for solidifying ground improvement medium from a nozzle of the second jet nozzle section and jetting the ground improvement medium from a nozzle of the first jet nozzle section.

In another aspect of the jet-mixing apparatus, the first jet nozzle section and the second jet nozzle section are disposed side-by-side horizontally and have their nozzles directed in substantially the same direction to make their jet directions substantially parallel and the reactant and ground improvement medium are jetted horizontally in parallel in the same direction. In another aspect of the jet-mixing apparatus, the second jet nozzle section for jetting the reactant is installed a prescribed distance above the first jet nozzle section for jetting the ground improvement medium and the rod is rotated and lifted to cause the reactant to be mixed with the ground first and the ground improvement medium to be mixed therewith thereafter. In another aspect of the jet-mixing apparatus, the second jet nozzle section for jetting the reactant is installed on the leading side relative to the rotational direction of the rod and the first jet nozzle section for jetting ground improvement medium consisting mainly of cement milk is installed on the trailing side at the lower end and the rod is rotated to cause the reactant to be mixed with the ground first and the ground improvement medium to be mixed therewith thereafter.

Since the jet-mixing method and jet-mixing apparatus according to the present invention are configured as described in the foregoing, they offer the following effects.

1. Since the force produced at the lower region of the rod by the jetting of the reactant and ground improvement medium and that produced by the jetting of the mixed compressed air and water upward thereof act in opposite directions, it is possible to prevent rod bending and divergence of the rod axis of rotation owing to a large load acting on the rod in a particular direction during pile casting.

2. Since the jet directions of the reactant and the ground improvement medium are horizontal and substantially parallel, the ground can be reliably churned and impregnated with the reactant and ground improvement medium, thereby preventing uneven mixing.

3. The reactant is mixed with the ground first and can therefore be mixed uniformly with the ground first, thus enabling provision of a jet-mixing method capable of preventing uneven mixing.

4. Since the jet nozzle section for jetting the reactant is installed a prescribed distance above the jet nozzle section for jetting the ground improvement medium, the reactant is mixed uniformly with the ground first, thereby enabling provision of a jet-mixing method capable of preventing uneven mixing.

5. Since discharged mud generated by the cutting operation, which would ordinarily be treated as industrial waste, is reused after being removed of solids of larger than a predetermined diameter, it is possible to provide a jet-mixing method that is economical and puts minimal load on the environment.

6. Use of the conveying pump makes jetting easy even when mud of relatively large grain size is used as ground improvement medium.

7. Since the force produced at the lower region of the rod by the jetting of materials from the first and second jet nozzle sections and that produced by the jetting of material from the third jet nozzle section upward thereof act in opposite directions, the jet-mixing apparatus can prevent rod bending and divergence of the rod axis of rotation owing to a large load acting on the rod in a particular direction during pile casting.

8. Since the jet directions of the first and second jet nozzle sections are horizontal and substantially parallel, the ground can be reliably churned and impregnated with the reactant and ground improvement medium, thereby enabling provision of a jet-mixing apparatus capable of preventing uneven mixing.

9. The reactant is mixed with the ground first and can therefore be mixed uniformly with the ground first, thus enabling provision of a jet-mixing apparatus capable of preventing uneven mixing.

10. Since the jet nozzle section for jetting the reactant is installed a prescribed distance above the jet nozzle section for jetting the ground improvement medium, the reactant is mixed uniformly with the ground first, thereby enabling provision of a jet-mixing apparatus capable of preventing uneven mixing.

DESCRIPTION OF THE PREFERRED EMBODIMENTS

Figure 1:
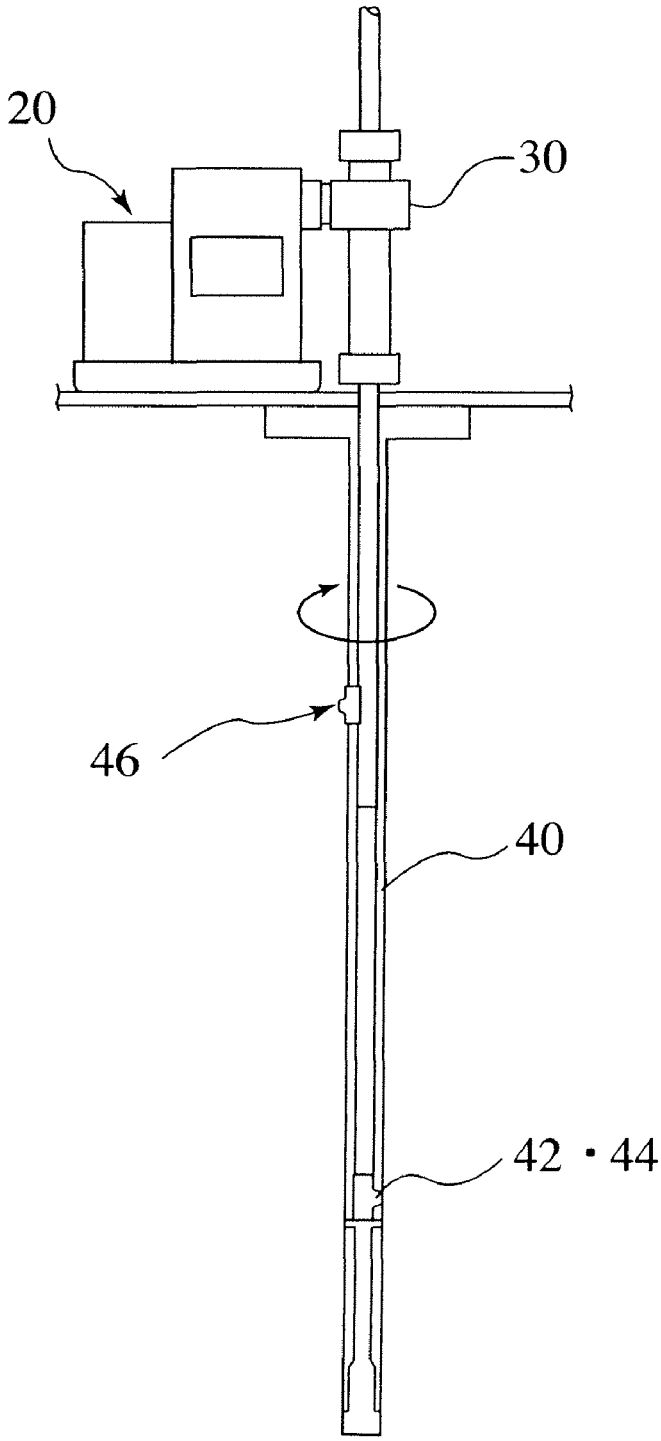
FIG. 1 is a schematic diagram showing a jet-mixing apparatus according to the present invention.

The jet-mixing method and jet-mixing apparatus according to the present invention will be explained in detail in the following with reference to embodiments shown in the drawings.

As shown in FIG. 1, the jet-mixing apparatus 10 of the present invention comprises a drive unit 20, thruster (feed unit) 3 and a rod 40. As other required components not shown in the drawing, there are separately provided pumps for pressurized delivery of water, compressed air, ground improvement medium and reactant to the interior of the rod 40. The drive unit 20 and thruster 30 can be of the same type as used in the prior art and the details thereof will be explained only to the extent necessary.

The rod 40 shown in the drawing is a multiple-tube rod equipped with a first jet nozzle section 42 and a second jet nozzle section 44 having nozzles facing in substantially the same direction and further equipped above the first and second jet nozzle sections with a third jet nozzle section 46 having a nozzle facing in substantially the opposite direction from those of the first and second jet nozzle sections. Passages are provided inside the rod for supplying water, compressed air, ground improvement medium and reactant to the respective nozzle sections. The passages are used to supply material to be jetted to the respective nozzle sections.

The internal structure of the rod is not limited to that illustrated in the drawings. For example, the rod may have a multiplex structure consisting of four tubes of different diameter for enabling water, compressed air, ground improvement medium and reactant to be individually pumped through the gaps between the tubes and jetted without intermixing. Moreover, as explained in further detail later, a mixing section for mixing compressed air and water is provided near the third jet nozzle section. However, no particular restriction is placed on the mixing method or the structure of the mixing section.

The first jet nozzle section 42 is constituted as a nozzle for jetting ground improvement medium consisting mainly of a hardening material such as cement milk and the second jet nozzle section 44 is constituted as a nozzle for jetting reactant in substantially the same direction as the jet direction of the first jet nozzle section 42. The shapes of the jet nozzle sections are not particularly limited and can be suitably determined taking into account the properties of the ground improvement medium and reactant used.

The ground improvement medium and reactant used in the conventional jet-mixing method can be used in the present invention without modification. The main component of the ground improvement medium used in the conventional ground jet-mixing method is a hardening material such as cement milk. Further, it is also possible to mix a hardening material with surplus soil obtained by removing solids of larger than a predetermined diameter from mud discharged when the jet-mixing method is conducted and to use the mixture as ground improvement medium. Although it is possible to separate and remove solids by a method using a sieve or the like, the method used is not particularly specified. As the reactant, there is used water glass, sodium silicate or other such material that promotes hardening by reacting with cement milk or the like. The ground improvement medium and reactant are only required to harden or reform the ground by reacting when mixed, and the properties and chemical composition thereof are not particularly defined.

Figure 2:
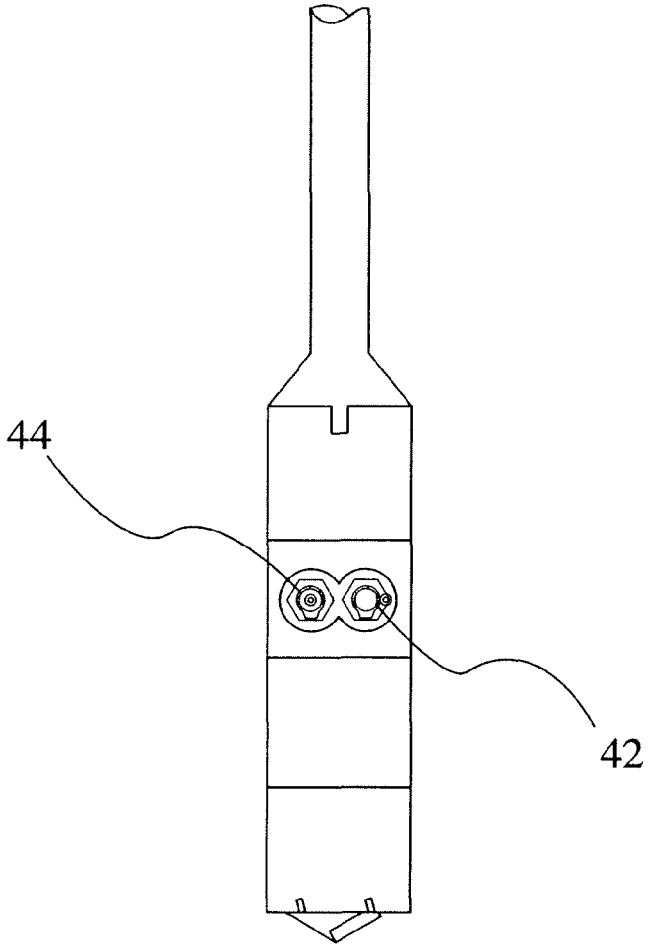
FIG. 2 is an enlarged view of the vicinity of a first jet nozzle section and a second jet nozzle section of a jet-mixing apparatus according to a first embodiment of the present invention.
Figure 3:
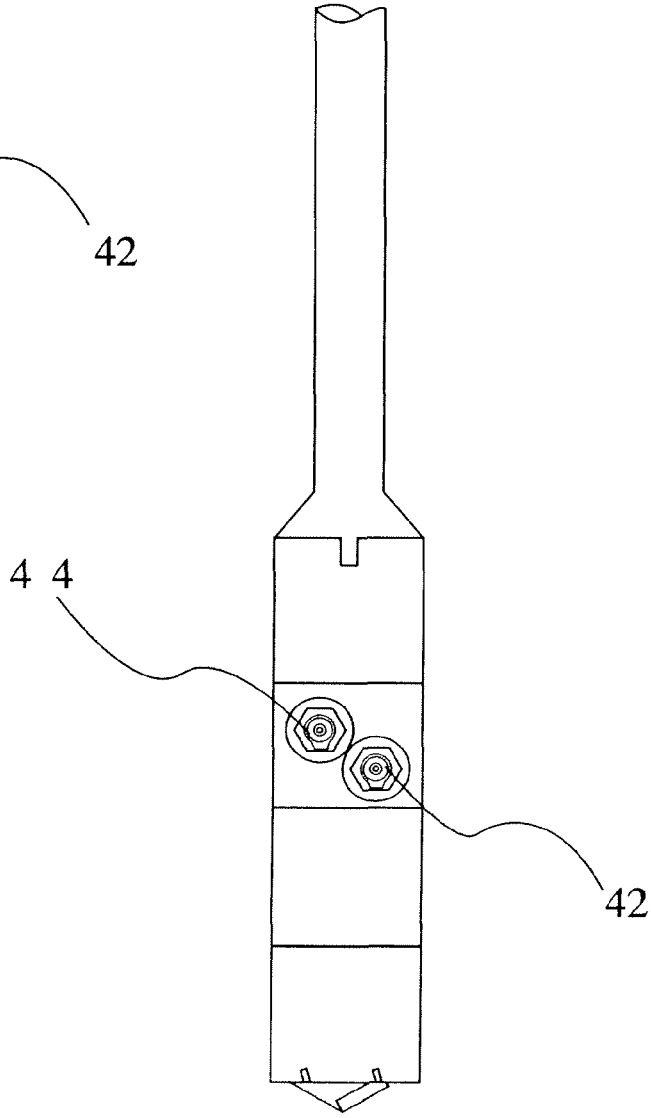
FIG. 3 is an enlarged view of the vicinity of a first jet nozzle section and a second jet nozzle section of a jet-mixing apparatus according to a second embodiment of the present invention.
Figure 4:
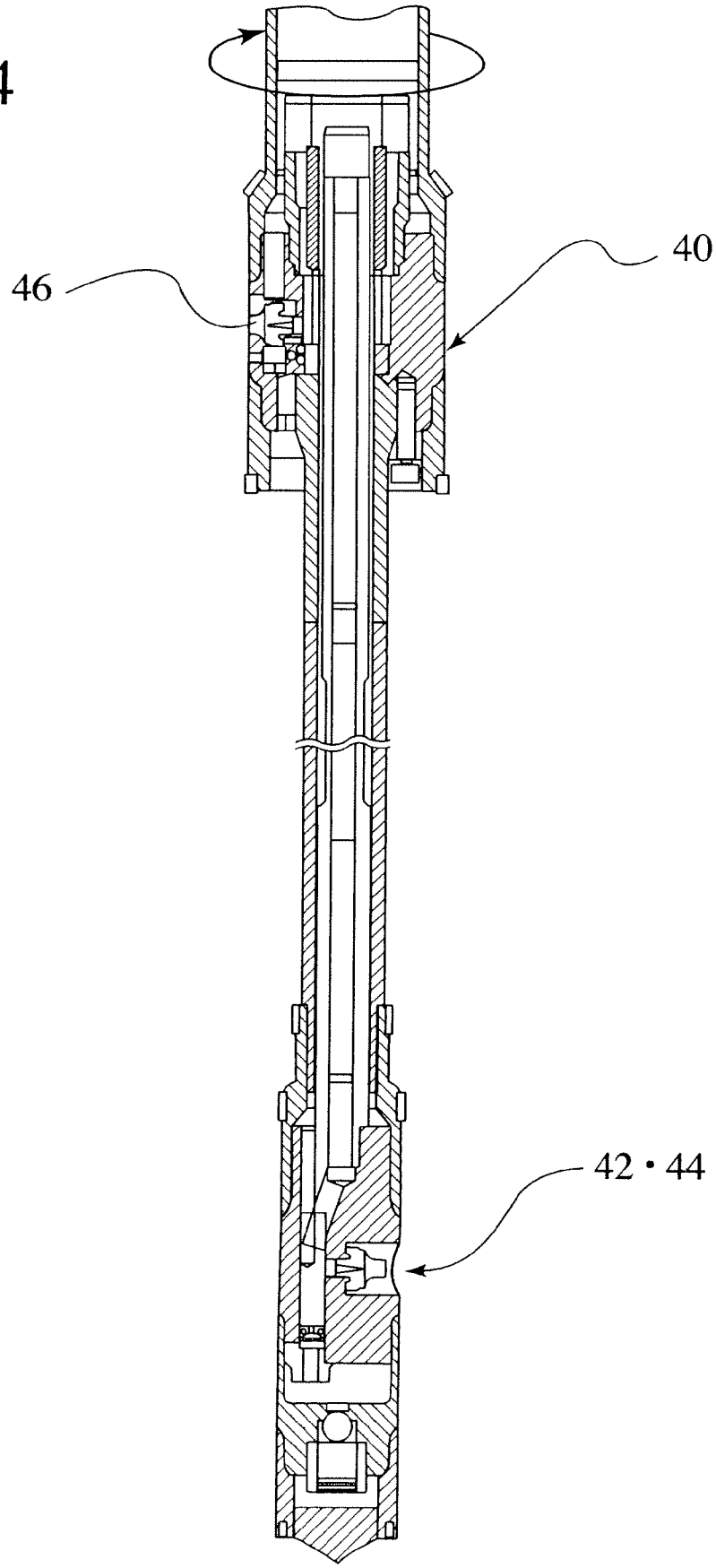
FIG. 4 is a cross-sectional view of a rod of a jet-mixing apparatus according to the present invention.

The positional relationship between the first jet nozzle section 42 and second jet nozzle section 44 need only be such that the materials jetted thereby are jetted in substantially the same direction and need not be defined exactly. The simplest configuration would be to dispose the first and second jet nozzle sections immediately above and below each other. In the present invention, however, uneven mixing of the reactant and ground improvement medium is minimized by, as shown in FIGS. 2 and 3, disposing the first and second jet nozzle sections in parallel or with a small vertical offset. Configurations having the first jet nozzle section 42 and second jet nozzle section 44 installed in the manner of FIGS. 2 and 3 are explained in detail below regarding the embodiments.

Although the jet directions of the first jet nozzle section 42 and second jet nozzle section 44 are preferably parallel, the jet directions need not be absolutely parallel. When the jet nozzle sections are disposed side-by-side in the horizontal direction so as to jet in a jet direction perpendicular to the rod, the direction of the force acting on the rod is the direction of the resultant force of the forces produced by jetting in the two directions. If the location and the jet direction and height of the third jet nozzle section 46 explained below are suitably determined, the directions of the first jet nozzle section 42 and second jet nozzle section 44 can be defined as desired. However, the location of the third jet nozzle section 46 is likely to be easier to decide when the jet directions in which the reactant and ground improvement medium are jetted in parallel are unified.

The third jet nozzle section 46 is constituted as a nozzle located above the first jet nozzle section 42 and second jet nozzle section 44 for jetting a mixture of compressed air and water in about the same direction as the reaction force produced by the jetting of material from the first and second jet nozzle sections. As in the case of the first and second jet nozzle sections, the shape of the nozzle of the third jet nozzle section is not particularly limited and can be any shape that enables the compressed air and water to be jetted at a prescribed pressure.

The location and direction of the third jet nozzle section 46 must be determined taking into account the locations and directions of the first and second jet nozzle sections, the direction(s) in which they jet material and the force(s) produced with respect to the rod during jetting. For example, when the first and second jet nozzle sections jet in parallel in a specific direction, the third jet nozzle section should be installed to jet in the opposite direction from the first and second jet nozzle sections. When the jet directions of the first and second jet nozzle sections are slightly different, the direction of the third jet nozzle section is determined based on the resultant force produced by the first and second jet nozzle sections.

The jet-mixing method of the present invention will now be explained in detail with reference to FIG. 1, focusing particularly on the points of difference from the conventional jet-mixing method. First, the rod 40 is thrust into the ground to the desired depth. Next, the rod is kept in rotation while being drawn upward. During the upward movement, compressed air and water are jetted from the third jet nozzle section 46 to reach a prescribed distance (range), thereby forming a cylindrical bored region (ground improvement region) centered on the rod. Although the jet-mixing apparatus 10 of the present invention is configured to jet compressed air and water in only one direction, it can achieve the same actions and effects as the conventional apparatus that conducts bidirectional jetting when the rotational speed and the like are appropriately set. It should be noted that when the third jet nozzle section 46 commences jetting, the jet reaction force simultaneously acts on the rod.

Mud composed of small stones, soil and water generated by cutting and crushing is discharged to the ground surface through the bored hole. The mud would ordinarily have to be treated as industrial waste but the present invention enables it to be reused by removing its water content, separating out solids of larger than a predetermined diameter, and then mixing the remaining mud with ground improvement medium. The present invention differs markedly from the prior art on this point.

Next, the rod 40 is gradually raised and when the lower first jet nozzle section 42 and second jet nozzle section 44 reach the ground improvement region, reactant is jetted from the second jet nozzle section 44 and ground improvement medium is jetted from the first jet nozzle section 42. The jetted materials are mixed and churned into the ground improvement region. When the first and second jet nozzle sections commence jetting, the resultant of the forces produced by the jetting simultaneously acts on the rod 40 in the direction opposite from the force produced by the third jet nozzle section 46. Since the forces are applied in opposite directions, bending of the rod is minimized to prevent wobbling of the rotating rod. The mixed reactant and ground improvement medium react and solidify to form a pile.

Embodiments of the jet-mixing method and jet-mixing apparatus characterized by the positioning of the first jet nozzle section 42 and second jet nozzle section 44 are explained in detail below with reference to the drawings.

First Embodiment

The jet-mixing method and jet-mixing apparatus of a first embodiment of the jet-mixing method and jet-mixing apparatus will be explained with reference to FIG. 2. The jet-mixing apparatus 10 used for the jet-mixing method of this embodiment is characterized in the point that the first jet nozzle section 42 and second jet nozzle section 44 are installed side-by-side in the horizontal direction and their nozzles are directed in substantially the same direction so as to make their jet directions substantially parallel. The second jet nozzle section 44 is installed on the leading side relative to the rotational direction of the rod and the first jet nozzle section 42 is installed on the trailing side.

The present invention teaches a jet-mixing method in which the second jet nozzle section 44 for jetting reactant is installed on the leading side of the rod rotation to mix the reactant with the ground first and the ground improvement medium is mixed later. The direction of rod rotation in this embodiment is indicated by an arrow in FIG. 1. Depending on the properties of the ground improvement medium and reactant used, it is possible that better effect may be obtained by mixing the ground improvement medium with the ground first. In such a case, a configuration should be adopted in which the positions of the first and second jet nozzle sections are reversed from the foregoing.

The first jet nozzle section 42 and second jet nozzle section 44 are positioned at the same height in the jet-mixing method and jet-mixing apparatus of this embodiment. The rotation of the rod therefore causes the reactant to be mixed with the ground first and the ground improvement medium to be jetted and mixed with the ground immediately thereafter. This is especially effective when it is desired to rapidly mix the reactant and ground improvement medium. It suffices to install the constituent first jet nozzle section 42 and second jet nozzle section 44 both at the same height. Although no particular restriction is placed on the nozzle angles, it is desirable for the jet directions of the jet nozzle sections to be as near parallel as possible.

Second Embodiment

The jet-mixing method and jet-mixing apparatus of a second embodiment of the jet-mixing method and jet-mixing apparatus will be explained with reference to FIG. 3. The jet-mixing apparatus 10 used for the jet-mixing method of this embodiment is characterized in the point that the second jet nozzle section 44 is located a prescribed distance above the first jet nozzle section 42 and the nozzles of the two jet nozzle sections are directed in substantially the same direction so as to make their jet directions substantially parallel. The second jet nozzle section 44 is installed on the leading side relative to the rotational direction of the rod and the first jet nozzle section 42 is installed on the trailing side.

In the jet-mixing method of this embodiment, the second jet nozzle section 44 for jetting the reactant is located above the first jet nozzle section 42 so as to mix the reactant with the ground before the ground improvement medium. Although the distance by which the second jet nozzle section 44 positioned above the first jet nozzle section 42 is not particularly defined, an appropriate proximal location enabling the reactant and ground improvement medium to be uniformly blended should be selected.

What is claimed is:

1. A jet-mixing method for casting a pile of predetermined diameter by thrusting or feeding into the ground a rod provided at its lower end with a first jet nozzle section for jetting ground improvement medium consisting mainly of cement milk and a second jet nozzle section for jetting reactant in substantially the same direction as the jet direction of the first jet nozzle section, and provided above the first and second jet nozzle sections with a third jet nozzle section for mixing and jetting compressed air and water in a direction opposite the jet direction of the first and second jet nozzle sections; jetting compressed air and water from the third jet nozzle section within a predetermined range while simultaneously rotating and upwardly extracting the rod from the ground, thereby jet-cutting a ground improvement region into a cylindrical shape; discharging mud generated by the cutting operation to the ground surface through a bored hole; and jetting reactant for solidifying ground improvement medium from a nozzle of the second jet nozzle section and jetting the ground improvement medium from a nozzle of the first jet nozzle section.

2. A jet-mixing method according to claim 1, wherein the first jet nozzle section and the second jet nozzle section are disposed side-by-side horizontally and have their nozzles directed in substantially the same direction to make their jet directions substantially parallel and the reactant and ground improvement medium are jetted horizontally in parallel in the same direction.

3. A jet-mixing method according to claim 2, wherein the second jet nozzle section for jetting the reactant is installed a prescribed distance above the first jet nozzle section for jetting the ground improvement medium and the rod is rotated and lifted to cause the reactant to be mixed with the ground first and the ground improvement medium to be mixed therewith thereafter.

4. A jet-mixing method according to claim 1, wherein the second jet nozzle section for jetting the reactant is installed on the leading side relative to the rotational direction of the rod and the first jet nozzle section for jetting ground improvement medium consisting mainly of cement milk is installed on the trailing side at the lower end and the rod is rotated to cause the reactant to be mixed with the ground first and the ground improvement medium to be mixed therewith thereafter.

5. A jet-mixing method according to claim 1, wherein solids of larger than a predetermined diameter are separated and removed from mud composed of water-containing soil discharged to the ground surface, whereafter the discharged mud is mixed with the ground improvement medium to form a mixed medium that is jetted from the first jet nozzle section as a ground improvement medium.

6. A jet-mixing method according to claim 5, wherein solids of larger than a predetermined diameter are separated and removed from mud composed of water-containing soil discharged to the ground surface, whereafter the discharged mud is mixed with the ground improvement medium to form a mixed medium that is force-fed by a conveying pump to be jetted from the first jet nozzle section as a ground improvement medium.

7. A jet-mixing apparatus comprising:

a rod provided at its lower end with a first jet nozzle section for jetting ground improvement medium consisting mainly of cement milk and a second jet nozzle section for jetting reactant in substantially the same direction as the jet direction of the first jet nozzle section, and provided above the first and second jet nozzle sections with a third jet nozzle section for mixing and jetting compressed air and water in a direction opposite the jet direction of the first and second jet nozzle sections, which jet-mixing apparatus casts a pile of predetermined diameter by thrusting or feeding the rod into the ground, jetting compressed air and water from the third jet nozzle section within a predetermined range while simultaneously rotating and upwardly extracting the rod from the ground, thereby jet-cutting a ground improvement region into a cylindrical shape; discharging mud generated by the cutting operation to the ground surface through a bored hole; and jetting reactant for solidifying ground improvement medium from a nozzle of the second jet nozzle section and jetting the ground improvement medium from a nozzle of the first jet nozzle section.

8. A jet-mixing apparatus according to claim 7, wherein the first jet nozzle section and the second jet nozzle section are disposed side-by-side horizontally and have their nozzles directed in substantially the same direction to make their jet directions substantially parallel and the reactant and ground improvement medium are jetted horizontally in parallel in the same direction.

9. A jet-mixing apparatus according to claim 7, wherein the second jet nozzle section for jetting the reactant is installed a prescribed distance above the first jet nozzle section for jetting the ground improvement medium and the rod is rotated and lifted to cause the reactant to be mixed with the ground first and the ground improvement medium to be mixed therewith thereafter.

10. A jet-mixing apparatus according to claim 7, wherein the second jet nozzle section for jetting the reactant is installed on the leading side relative to the rotational direction of the rod and the first jet nozzle section for jetting ground improvement medium consisting mainly of cement milk is installed on the trailing side at the lower end and the rod is rotated to cause the reactant to be mixed with the ground first and the ground improvement medium to be mixed therewith thereafter.

* * * * *